US009593390B2

(12) United States Patent
Katsumata

(10) Patent No.: US 9,593,390 B2
(45) Date of Patent: Mar. 14, 2017

(54) HEAT TREATMENT METHOD

(75) Inventor: Kazuhiko Katsumata, Saitama (JP)

(73) Assignee: IHI CORPORATION (JP)

( * ) Notice: Subject to any disclaimer, the term of this patent is extended or adjusted under 35 U.S.C. 154(b) by 276 days.

(21) Appl. No.: 13/636,530

(22) PCT Filed: Mar. 24, 2011

(86) PCT No.: PCT/JP2011/057249

§ 371 (c)(1),
(2), (4) Date: Sep. 21, 2012

(87) PCT Pub. No.: WO2011/118737

PCT Pub. Date: Sep. 29, 2011

(65) Prior Publication Data

US 2013/0008567 A1 Jan. 10, 2013

(30) Foreign Application Priority Data

Mar. 25, 2010 (JP) ..... P2010-070242

(51) Int. Cl.
*C21D 6/00* (2006.01)
*C21D 1/667* (2006.01)
(Continued)

(52) U.S. Cl.
CPC ..... *C21D 1/667* (2013.01); *C21D 1/20* (2013.01); *C21D 1/22* (2013.01); *C21D 1/76* (2013.01);
(Continued)

(58) Field of Classification Search
CPC .. C22F 1/04; C22C 21/00; C21D 1/74; C21D 9/0068; C21D 6/00; C21D 1/56; C21D 1/62; C21D 1/667
(Continued)

(56) References Cited

U.S. PATENT DOCUMENTS 4,504,042 A * 3/1985 Kruppert ..... C21D 9/085 266/115
4,509,995 A 4/1985 Hachisu et al.
(Continued)

FOREIGN PATENT DOCUMENTS

JP 52-061119 5/1977
JP 52061119 A * 5/1977
(Continued)

OTHER PUBLICATIONS

Chinese Office Action, dated May 6, 2013, issued in corresponding Chinese Application No. 201180015345.9, filed Mar. 24, 2011. English translation included. Total 10 pages.
(Continued)

*Primary Examiner* — Jessee Roe
*Assistant Examiner* — Jenny Wu
(74) *Attorney, Agent, or Firm* — Ostrolenk Faber LLP

(57) ABSTRACT

The heat treatment method of the present invention includes: a first step of mist cooling a treatment object retained at a prescribed temperature by supplying mist-like coolant, to a target temperature near to and higher than a first transformation point at which a structure of the treatment object begins to be transformed into a prescribed structure; a second step, following the first step, of retaining the treatment object for a prescribed time in a state where supply of mist-like coolant is stopped; and a third step, following the second step, of cooling the treatment object to a temperature lower than or equal to the first transformation point. According to the present invention, it is possible to provide a heat treatment method capable of suppressing irregularity and deformation in the structure of the treatment object.

14 Claims, 9 Drawing Sheets

(51) Int. Cl.

| | |
|---|---|
| ***C21D 1/76*** | (2006.01) |
| ***C21D 9/00*** | (2006.01) |
| ***F27B 9/20*** | (2006.01) |
| ***F27B 9/24*** | (2006.01) |
| ***F27B 9/26*** | (2006.01) |
| ***F27D 7/06*** | (2006.01) |
| ***F27D 9/00*** | (2006.01) |
| ***F27D 15/02*** | (2006.01) |
| ***C21D 1/20*** | (2006.01) |
| ***C21D 1/22*** | (2006.01) |

(52) U.S. Cl.
CPC ..... *C21D 9/0056* (2013.01); *C21D 9/0062* (2013.01); *F27B 9/20* (2013.01); *F27B 9/2407* (2013.01); *F27B 9/26* (2013.01); *F27D 7/06* (2013.01); *F27D 9/00* (2013.01); *F27D 15/0206* (2013.01); *C21D 2211/008* (2013.01); *C21D 2211/009* (2013.01); *F27D 2009/0005* (2013.01); *F27D 2009/0075* (2013.01)

(58) Field of Classification Search
USPC ..... 148/551, 559
See application file for complete search history.

(56) References Cited

U.S. PATENT DOCUMENTS

| | | | | |
|---|---|---|---|---|
| 6,443,214 | B1 | 9/2002 | Matsuo et al. | |
| 6,585,834 | B1 | 7/2003 | Kapaan et al. | |
| 2011/0262877 | A1* | 10/2011 | Katsumata | F27B 9/02 432/77 |
| 2016/0059114 | A1* | 3/2016 | Alanis | A63F 9/0613 273/238 |

FOREIGN PATENT DOCUMENTS

| | | | | |
|---|---|---|---|---|
| JP | 55-065318 | | 5/1980 | |
| JP | 55065318 | A * | 5/1980 | |
| JP | U 05-30146 | | 4/1993 | |
| JP | 10-081913 | | 3/1998 | |
| JP | 10-216827 | | 8/1998 | |
| JP | 11-153386 | | 6/1999 | |
| JP | 2000-313920 | | 11/2000 | |
| JP | 2002-194435 | | 7/2002 | |
| JP | 2002194435 | A * | 7/2002 | |
| JP | 2005-163155 | | 6/2005 | |
| JP | 2008-121064 | | 5/2008 | |
| JP | WO 2010005083 | A1 * | 1/2010 | F27B 9/02 |

OTHER PUBLICATIONS

International Search Report and Written Opinion mailed Jun. 28, 2011 in corresponding PCT International Application No. PCT/JP2011/057249.

Japanese Office Action, dated Jan. 14, 2014, issued in corresponding Japanese Patent Application No. 2010-070242. Total 9 pages, including English translation.

Search Report dated Jan. 19, 2015 in corresponding European Patent Application No. 11759542.1(with English language translation)(5 pages).

Satish C. Koria, et al., "Studies on the Behaviour of Mist Jet and Its Cooling Capacity of Hot Steel Surface," Steel Research, Duesseldorf, DE, vol. 63, No. 1, Jan. 1, 1992, pp. 19-26, XP009181637, ISSN: 0177-4832.

* cited by examiner

HEAT TREATMENT METHOD

CROSS-REFERENCE TO RELATED APPLICATIONS

The present application is a 35 U.S.C. §§371 national phase conversion of PCT/JP2011/057249, filed Mar. 24, 2011, which claims priority of Japanese Patent Application No. 2010-070242, filed Mar. 25, 2010, the contents of which are incorporated herein by reference. The PCT International Application was published in the Japanese language.

TECHNICAL FIELD

The present invention relates to a heat treatment method, and relates in particular to a heat treatment method for quenching of treatment objects by mist cooling.

BACKGROUND ART

With respect to heat treatment methods for quenching by cooling of a metal material that constitutes a treatment object after it has been heated, oil cooling systems and gas cooling systems have conventionally been used if high-speed cooling is required.

In the aforementioned oil cooling systems, cooling efficiency is excellent, but fine cooling control is almost impossible, and the treatment object tends to deform. On the other hand, in the gas cooling systems, cooling control by gas flow rate control or the like is easy, inhibiting deformation of the treatment object, but cooling efficiency is poor.

Patent Document 1 discloses a technology which seeks improvement in cooling controllability and cooling efficiency by disposing liquid nozzles and gas nozzles around the treatment object, supplying cooling liquid from the liquid nozzles in a manner of spray (so-called mist cooling), and supplying cooling gas from the gas nozzles.

DOCUMENT OF RELATED ART

Patent Document

[Patent Document 1] Japanese Patent Application, First Publication No. H11-153386

SUMMARY OF INVENTION

Technical Problem

However, since the basic cooling of mist cooling is cooling by latent heat of vaporization, a temperature difference may arise between the interior and exterior of the treatment object due to the degree of contact with the mist. This temperature difference may exert adverse effects on the quality thereof. For example, even if the temperature at the outer surface of the treatment object reaches a prescribed structural transformation point, in the case where the interior of the treatment object still has a high temperature and its temperature has not reached the transformation point, irregularity may occur in the internal and external structure of the treatment object. Furthermore, when the structure at the outer surface of the treatment object is transformed before the interior of the treatment object, internal stress arises and thereby the treatment object may be deformed.

The present invention was made in light of the foregoing circumstances, and offers a heat treatment method capable of inhibiting occurrence of irregularity and deformation in the structure of a treatment object.

Solution to Problem

The first invention of the present invention includes: a first step of mist cooling a treatment object retained at a prescribed temperature by supplying mist-like coolant, to a target temperature near to and higher than a first transformation point at which a structure of the treatment object begins to be transformed into a prescribed structure; a second step, following the first step, of retaining the treatment object for a prescribed time in a state where supply of the mist-like coolant is stopped; and a third step, following the second step, of cooling the treatment object to a temperature lower than or equal to the first transformation point.

In the present invention, even if a temperature difference arises between the interior and exterior of a treatment object in the first step, enlargement of the temperature difference between the interior and exterior of the treatment object is suppressed during the period of mist cooling stoppage in the second step, and the temperature difference is moderated by heat conduction between the interior and exterior of the treatment object. It is possible to transform the internal and external structure of the treatment object to the prescribed structure at the approximately same time, by cooling the treatment object to a temperature lower than or equal to the transformation point of the prescribed structure in a state where the temperature difference between the interior and exterior of the treatment object has been moderated.

In the present invention, it is desirable to include a cooling slowdown step between the first step and the second step, of supplying the mist-like coolant so that the treatment object is mist cooled at a mist density that is less than a mist density of the first step.

Although the temperature difference is moderated by heat conduction between the interior and exterior of the treatment object in the second step, there is a possibility that the temperature of the whole of the treatment object exceeds the target temperature due to heat conduction from the high-temperature interior, and that the temperature of the whole reaches a transformation point of another structure that is not desired. In the present invention, by slowing cooling the treatment object before the second step begins, it is possible to moderate the temperature difference between the interior and exterior of the treatment object, and prevent the temperature of the whole of the treatment object from exceeding the target temperature due to heat conduction between the interior and exterior of the treatment object.

In the present invention, it is desirable to include a step of measuring a temperature of an outer surface of the treatment object, and to have transition occur from the first step to the cooling slowdown step when a measured temperature of the outer surface reaches the target temperature.

In this case, while monitoring the temperature of the outer surface of the treatment object, cooling slowdown is initiated when the temperature of the outer surface of the treatment object reaches the target temperature.

In the present invention, it is desirable to include a step of measuring a temperature of the interior of the treatment object, and to have transition occur from the cooling slowdown step to the second step when a measured temperature of the interior reaches the target temperature.

In this case, while monitoring the temperature of the interior of the treatment object, cooling slowdown is terminated when the temperature of the interior of the treatment object reaches the target temperature.

In the present invention, it is desirable to measure a temperature of the interior of the treatment object based on a temperature of an outer surface of the treatment object.

In this case, the number of installed temperature measurement devices can be reduced.

The second invention of the present invention includes: a first step of mist cooling a treatment object retained at a prescribed temperature by supplying mist-like coolant, to a target temperature near to and higher than a first transformation point at which a structure of the treatment object begins to be transformed into a prescribed structure; a second step, following the first step, of mist cooling the treatment object for a prescribed time at a mist density that is less than a mist density of the first step; and a third step, following the second step, of cooling the treatment object to a temperature lower than or equal to the first transformation point.

In the present invention, even if a temperature difference arises between the interior and exterior of a treatment object in the first step, enlargement of the temperature difference between the interior and exterior of the treatment object is suppressed during the mist cooling period at lesser mist density in the second step, and the temperature difference is moderated by heat conduction between the interior and exterior of the treatment object. It is possible to transform the internal and external structure of the treatment object to the prescribed structure at the approximately same time, by cooling the treatment object to a temperature lower than or equal to the transformation point of the prescribed structure in a state where the temperature difference between the interior and exterior of the treatment object has been moderated.

In the present invention, it is desirable to set the target temperature between the first transformation point and a second transformation point with a temperature higher than the first transformation point at which the structure begins to be transformed into a structure other than the prescribed structure.

Furthermore, it is desirable that the first transformation point is a martensite transformation point, and that the second transformation point is a pearlite transformation point.

Effects of Invention

According to the present invention, occurrence of irregularity and deformation in the structure of a treatment object can be inhibited.

DESCRIPTION OF EMBODIMENTS

An embodiment of the present invention is described below based on FIG. 1 to FIG. 5C.

In each of the drawings used in the following description, the dimensions of each member are appropriately modified so as to set a size that enables recognition of each member.

Moreover, in the present embodiment, a multi-chamber vacuum heat treatment furnace (hereinafter simply "vacuum heat treatment furnace") is shown as a heat treatment device that performs a heat treatment method of the present invention.

Figure 1:
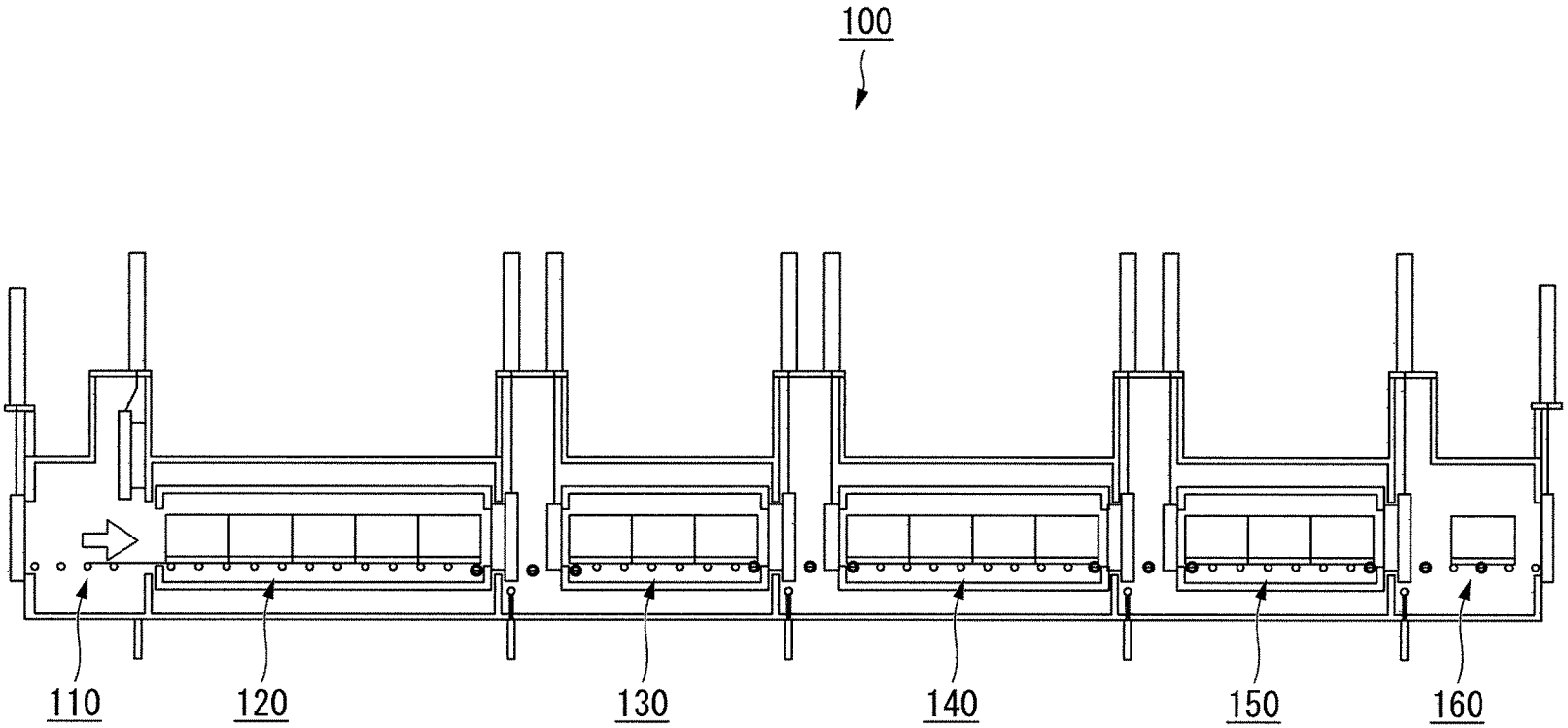
FIG. 1 is an overall view of a vacuum heat treatment furnace in an embodiment of the present invention.

FIG. 1 is an overall view of the vacuum heat treatment furnace of the present embodiment.

A vacuum heat treatment furnace (heat treatment device) 100 conducts heat treatment on treatment objects. In the vacuum heat treatment furnace 100, a deaerating chamber 110, a preheating chamber 120, a carburizing chamber 130, a diffusion chamber 140, a temperature reducing chamber 150, and a cooling chamber 160 are disposed in a sequentially adjacent manner. The treatment objects are sequentially conveyed in a single row through the chambers 110-160.

The cooling chamber 160 is described in detail below because the cooling treatment in the cooling chamber 160 is characteristic in the vacuum heat treatment furnace 100 of the present embodiment.

Figure 2:
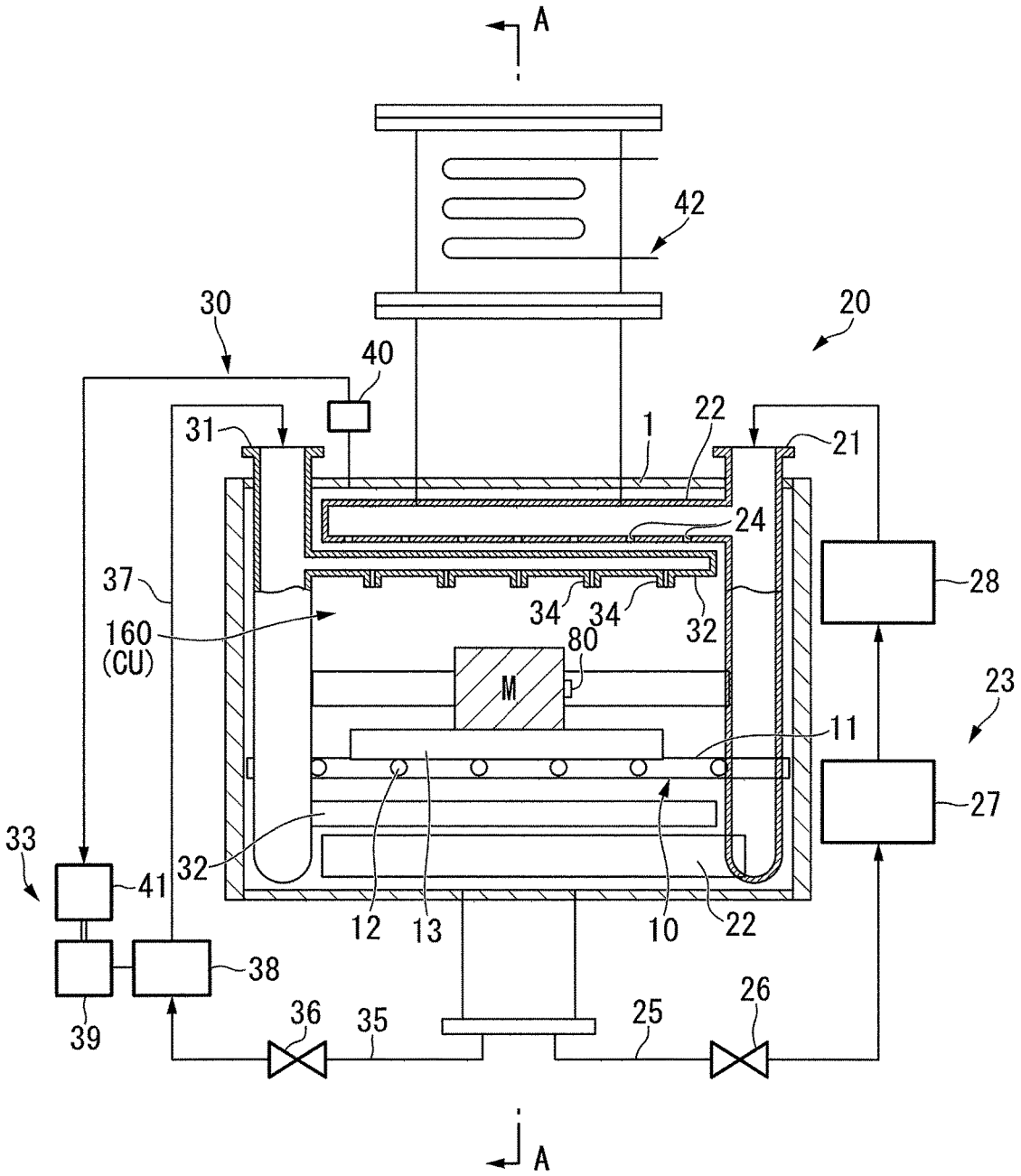
FIG. 2 is a cross-sectional front view of a cooling chamber in the embodiment of the present invention.
Figure 3:
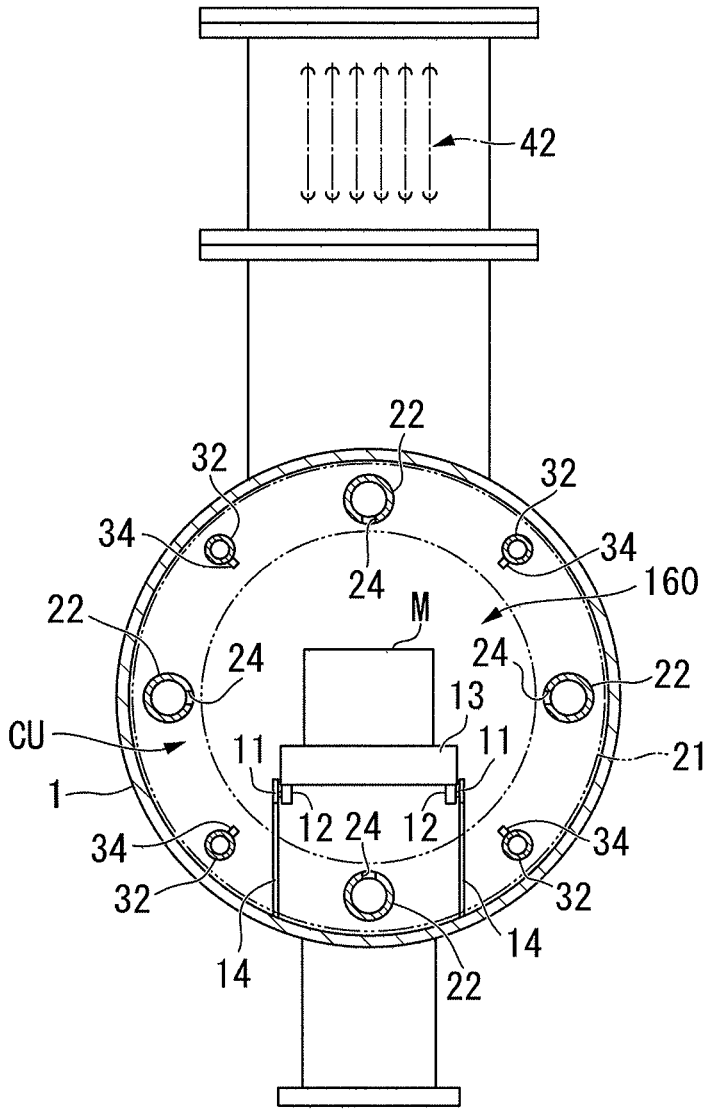
FIG. 3 is a cross-sectional view along line A-A in FIG. 2.

FIG. 2 is a cross-sectional front view of the cooling chamber 160, and FIG. 3 is a cross-sectional view along line A-A in FIG. 2. The cooling chamber 160 is formed inside a vacuum container 1. The inside of the vacuum container 1 is provided with a cooling unit CU including a conveyor 10, a gas cooling device 20, a mist cooling device 30, and a temperature measurement device 80.

The conveyor 10 is capable of conveying a treatment object M in a horizontal direction. The conveyor 10 includes a pair of support frames 11 which are disposed facing to each other with a space and which extend in a conveyance direction (horizontal direction), rollers 12 which are provided rotatably on the facing surfaces of the support frames 11 at prescribed intervals in the conveyance direction, a tray 13 on which the treatment object M is placed and which is conveyed on the rollers 12, and support frames 14 (not illustrated in FIG. 2) which are vertically provided and which support both ends of the support frames 11.

In the following description, the conveyance direction of the treatment object M by the conveyor 10 is simply referred to as the conveyance direction.

The tray 13 is formed in a rectangular parallelepiped shape by, for example, arranging plate materials in a lattice pattern. The width of the tray 13 is slightly larger than the width of the treatment object M, and the tray 13 is formed to a size that is supported by the rollers 12 at the widthwise edges of the bottom face.

The treatment object M may be exemplified by steel such as dies steel (SKD material) or high-speed steel (SKH material). In the present embodiment, the following description concerns the case where the treatment object M is dies steel (SKD61).

The gas cooling device 20 cools the treatment object M by supplying cooling gas to the interior of the cooling chamber 160. The gas cooling device 20 is provided with a header pipe 21, supply pipes 22, and a gas recovery/supply system 23. As shown by the double-dotted line in FIG. 3, the header pipe 21 is disposed at the end of the downstream side in the conveyance direction of the cooling chamber 160, and is formed annularly centering on the conveyance path of the treatment object M by the conveyor 10. Cooling gas is supplied to this header pipe 21 by the gas recovery/supply system 23.

The supply pipes 22 are formed to connect one ends thereof to the header pipe 21, and to horizontally extend at the other end side toward the upstream side in the conveyance direction. The supply pipes 22 are provided in plurality (four in the present embodiment) at approximately regular intervals in the circumferential direction (90° intervals in the present embodiment) centering on the conveyance path of the treatment object M by the conveyor 10. As shown in FIG. 3, the supply pipes 22 are provided at the 3 o'clock, 6 o'clock, 9 o'clock, and 12 o'clock positions (at the left, right, top and bottom positions) of the annular header pipe 21. Each supply pipe 22 is formed with a length that covers the length of the cooling chamber 160, so that the other end side horizontally extends toward the upstream side in the conveyance direction of the cooling chamber 160. In each supply pipe 22, discharge ports 24 which open toward the conveyance path of the treatment object are formed in plurality at prescribed intervals over the entire length thereof.

The gas recovery/supply system 23 has as its main components an exhaust pipe 25 connected to the vacuum container 1, an on-off valve 26 provided in the exhaust pipe 25, a heat exchanger 27 which serves as a cooler that recools cooling gas recovered by the exhaust pipe 25, and a fan 28 which supplies recooled cooling gas to the header pipe 21.

As the cooling gas, for example, inert gas such as argon, helium or nitrogen may be used.

By closing an on-off valve 36 in a cooling liquid recovery/supply system 33 and opening the on-off valve 26 in the gas recovery/supply system 23, the gas recovery/supply system 23 is capable of recooling cooling gas introduced to the exhaust pipe 25 from the cooling chamber 160 by the heat exchanger 27, and of supplying cooling gas so as to be circulated to the header pipe 21 by the operation of the fan 28.

The mist cooling device 30 cools the treatment object M by supplying cooling liquid to the interior of the cooling chamber 160 in the form of mist. The mist cooling device 30 is provided with a header pipe 31 (not illustrated in FIG. 3), supply pipes 32, and the cooling liquid recovery/supply system 33. The header pipe 31 is disposed at the end of the upstream side in the conveyance direction of the cooling chamber 160, and is formed annularly centering on the conveyance path of the treatment object M by the conveyor 10. This header pipe 31 is supplied with cooling liquid by the cooling liquid recovery/supply system 33.

The supply pipes 32 are formed to connect one ends thereof to the header pipe 31, and to horizontally extend at the other end side toward the downstream side in the conveyance direction. The supply pipes 32 are provided in plurality (four in the present embodiment) at approximately regular intervals in the circumferential direction (90° intervals in the present embodiment) centering on the conveyance path of the treatment object M by the conveyor 10. As shown in FIG. 3, the supply pipes 32 are provided at ±45° positions from the horizontal direction in the annular header pipe 31. Each supply pipe 32 is formed with a length that covers the length of the cooling chamber 160, so that the other end side horizontally extends toward the downstream side in the conveyance direction of the cooling chamber 160. In each supply pipe 32, nozzles 34 which spray cooling liquid in the form of mist toward the conveyance path of the treatment object are formed in plurality at prescribed intervals over the entire length thereof.

With respect to the arrangement positions of the supply pipes 32 and nozzles 34, as the mist-like cooling liquid is affected by gravity, it is preferable to avoid vertically supplying the cooling liquid because differences in the supply amounts may occur. Consequently, it is preferable to supply the mist-like cooling liquid horizontally. Of course, even when the cooling liquid is supplied vertically, it is acceptable to adjust the supply amounts in consideration of the effects of gravity. Moreover, in the case where, for example, three supply pipes 32 are arranged rather than four, in order to minimize vertical components to the utmost, it is preferable to arrange the supply pipes 32 at the zenith and at positions by ±120° sandwiching this zenith.

The cooling liquid recovery/supply system 33 has as its main components a drain pipe 35 connected to the vacuum container 1, the on-off valve 36 provided in the drain pipe 35, a pump 38 which supplies cooling liquid recovered by the drain pipe 35 to the header pipe 31 via piping 37 by the driving of a motor 39, a sensor 40 which measures the pressure (gas pressure) of the cooling chamber 160, a controller 41 which includes an inverter that controls the driving of the motor 39 and which conducts flow rate control of the cooling liquid based on the measurement results of the sensor 40, and a liquefier (liquefaction trap) 42 which liquefies vapor of the cooling liquid that has been vaporized by the heat received from the treated products.

As the cooling liquid, for example, oil, salty liquid, the below-mentioned fluorine inert liquid, and the like may be used.

By driving the motor 39 to operate the pump 38 in a state where the on-off valve 26 in the gas recovery/supply system 23 is closed and the on-off valve 36 in the cooling liquid recovery/supply system 33 is opened, the cooling liquid recovery/supply system 33 is able to supply cooling liquid, which is liquefied on the inner wall surface of the vacuum container 1 or in the liquefier 42 after being supplied to the cooling chamber 160 in mist form and which collects at the bottom of the vacuum container 1, so that the cooling liquid is circulated to the header pipe 31 via the piping 37. In particular, when the sensor 40 detects that the supply/injection amount of cooling liquid has decreased due to a decrease in gas pressure inside the cooling chamber 160, the controller 41 controls the driving of the motor 39 to adjust the supply amount of cooling liquid, thereby enabling constant supply of an appropriate amount of cooling liquid to the header pipe 31.

A temperature sensor 80 is provided on the outer surface of the treatment object M to measure the temperature of the treatment object M. The measurement results of the temperature sensor 80 are outputted to the controller 41. As the temperature sensor 80, a thermocouple is provided in the present embodiment. Of course, the temperature may also be measured using a non-contact sensor such as, for example, a radiation thermometer.

The controller 41 controls the driving of the motor 39 based on the measurement results of the temperature sensor 80. The controller 41 of the present embodiment retains the correlation between the supply amount per hour of mist-like cooling liquid and the internal and external temperature of the treatment object M in memory as a table, and is able to measure the internal temperature of the treatment object M from the measurement results of the temperature sensor 80 (outer surface temperature of the treatment object M). The aforementioned correlation table is prepared, for example, by preliminary experiments, simulations or the like.

Figure 4:
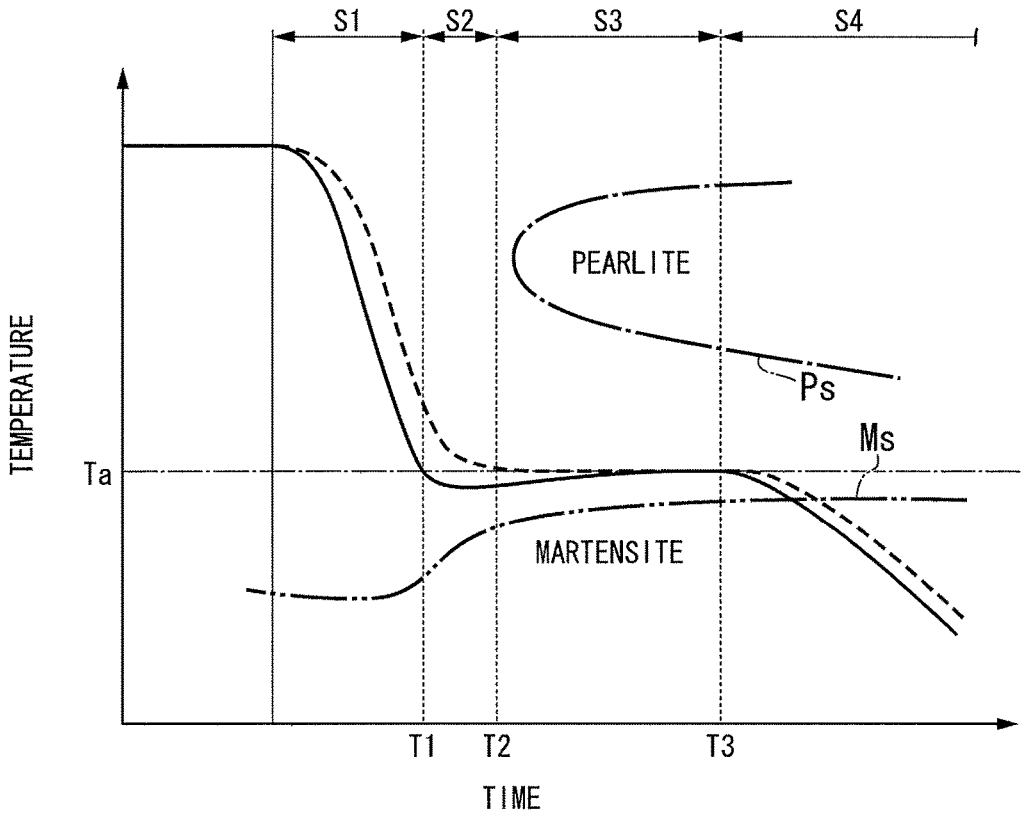
FIG. 4 is a graph to explain a heat treatment method of the embodiment of the present invention.
Figure 5A:
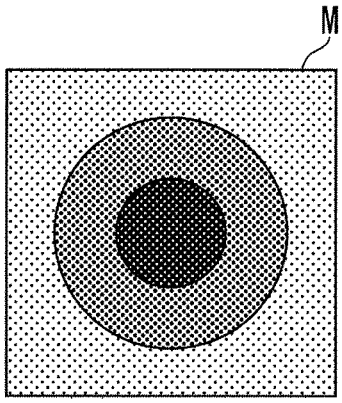
FIG. 5A is a first schematic cross-sectional view to explain temperature differences between the interior and exterior of a treatment object in the embodiment of the present invention.
Figure 5B:
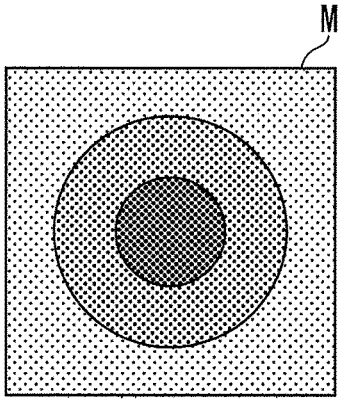
FIG. 5B is a second schematic cross-sectional view to explain temperature differences between the interior and exterior of the treatment object in the embodiment of the present invention.
Figure 5C:
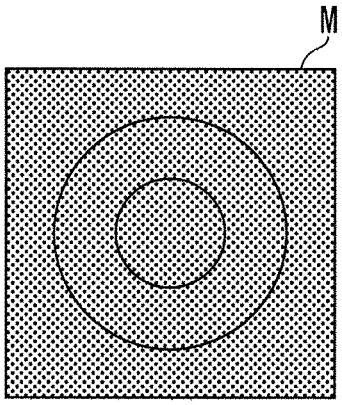
FIG. 5C is a third schematic cross-sectional view to explain temperature differences between the interior and exterior of the treatment object in the embodiment of the present invention.

Next, the procedure by which the heated treatment object M is cooled in the cooling chamber 160 in the aforementioned vacuum heat treatment furnace 100 is described based on FIG. 4 to FIG. 5C. In the following description, quenching treatment is described whereby the treatment object M retained at a quenching temperature is transformed into a martensitic structure.

FIG. 4 is a graph to explain the heat treatment method of the present embodiment. FIGS. 5A-5C are schematic cross-sectional views to explain temperature differences between the interior and exterior of the treatment object M of the present embodiment.

In FIG. 4, the vertical axis shows temperature, and the horizontal axis shows time. Moreover, in FIG. 4, the solid line shows temperature changes at the outer surface of the treatment object M, and the broken line shows temperature changes at the interior of the treatment object M. FIGS. 5A-5C show the conditions of temperature distribution in the treatment object M which undergoes sequential change in connection with the course of time of FIG. 4. FIG. 5A shows temperature distribution at time T1, FIG. 5B shows temperature distribution at time T2, and FIG. 5C shows temperature distribution at time T3. In FIGS. 5A-5C, the high temperature and low temperature are indicated by the shading of the dot pattern, with the dark dot pattern indicating high temperature.

In the heat treatment method of the present embodiment, first, a treatment object which has been heated (to about 1000° C.) so as to be into a condition of austenitic structure is mist cooled by supplying mist-like cooling liquid, to a target temperature Ta near to and higher than a transformation point Ms (first transformation point) at which transformation into a martensitic structure begins (first step S1: rapid cooling step).

The target temperature Ta is set to within a range from lower than a transformation point Ps (second transformation point) at which the treatment object M begins to be transformed into a pearlite structure, to higher than the transformation point Ms at which the treatment object M begins to be transformed into a martensitic structure. In the present embodiment, since the treatment object M is dies steel (SKD61), the target temperature Ta is set to between 370° C.-550° C. In consideration of the process in the below-described third step, the target temperature Ta is preferably set to a temperature near to the transformation point Ms (the temperature that is more than 10° C. higher than the transformation point Ms).

In the first step S1, the treatment object M is rapidly cooled by mist cooling to the target temperature Ta so as to avoid the transformation point Ps (so-called pearlite nose) at which transformation into a pearlite structure begins.

In the present embodiment, cooling is conducted by supplying/spraying cooling liquid in mist form from the nozzles 34 in the mist cooling device 30 toward the treatment object M that has been conveyed in the cooling chamber 160. By setting the diffusion angle from each nozzle 34 at, for example, 90° as shown in FIG. 3, it is possible to spray cooling liquid over the entirety of the side faces (outer surface) of the treatment object M. With respect to cooling liquid that has been sprayed from nozzles 34 positioned diagonally downward from the treatment object M (tray 13), since the tray 13 is formed by arranging plate materials in a lattice pattern, the cooling liquid can pass through between the plate materials, and appropriately reach and cool the treatment object M. Since the nozzles 34 are provided over the entirety of the lengthwise direction of the cooling chamber 160, the mist-like cooling liquid can also reach and cool the front face and rear face of the treatment object M in the conveyance direction, particularly by spray from nozzles 34 positioned at the both end sides of the supply pipe 32. Since the mist-like cooling liquid is supplied to the all outer surfaces of the treatment object M at a prescribed mist density, the treatment object M can be appropriately cooled by the latent heat of vaporization of the mist-like cooling liquid.

In the case of cooling using this mist-like cooling liquid, it is possible to conduct heat exchange with the treatment object M by continuously supplying the cooling liquid. Consequently, cooling treatment of the treatment object M can be continuously conducted, because there is no occurrence of the disadvantage of reduction in cooling efficiency by a decreasing area of contact with cooling liquid due to air bubbles arising from the boiling of cooling liquid that contacts the high-temperature treatment object M, nor of marked reduction in cooling efficiency resulting from an increasing quantity of air bubbles which constitute a vapor film that forms a heat-insulating layer, as in the case where the treatment object M is immersed in cooling liquid.

It is also acceptable to conduct supply/injection of cooling gas from the discharge ports 24 of the gas cooling device 20 simultaneous with supply/injection of cooling liquid in mist form from the nozzles 34 of the mist cooling device 30. According to this method, it is possible to render the atmosphere of the cooling chamber 160 uniform by diffusing cooling liquid that is sprayed in mist form into the cooling chamber 160 by the flow of cooling gas, enabling mitigation of cooling irregularity.

Since the basic cooling of mist cooling is cooling by latent heat of vaporization, a temperature difference arises between the interior and exterior of the treatment object depending on the degree of contact with the mist (see FIG. 5A). For example, as shown in FIG. 4, the temperature of the outer surface of the treatment object M undergoes temperature reduction in a shorter period of time than the temperature of the interior of the treatment object M, and thus the temperature difference between the interior and exterior of the treatment object M increases with the passage of time.

Next, in the heat treatment method of the present embodiment, when the measurement result of the temperature sensor 80 provided on the outer surface of the treatment object M reaches the target temperature Ta, mist-like cooling liquid is supplied so that the treatment object M is mist cooled at a mist density that is smaller than the mist density of the first step (cooling slowdown step S2).

In the cooling slowdown step S2, the mist density in the vicinity of the outer surface of the treatment object M in the cooling chamber 160 is lowered, and the treatment object M is cooled with a lower cooling efficiency than in the first step S1. In this case, with respect to the treatment object M, the temperature difference between the interior and exterior of the treatment object M decreases by transfer of heat from the high-temperature interior to the low-temperature outer surface by heat conduction.

In the cooling slowdown step S2, cooling is performed so as to prevent the temperature of the whole of the treatment object M from becoming higher than the target temperature Ta due to heat conduction from the high-temperature interior, and to prevent the temperature from reaching the transformation point of another structure that is not desired (e.g., transformation point Ps). That is, in the cooling slowdown step S2, cooling is performed so as to cancel the temperature rise of the whole of the treatment object M due to heat conduction from the high-temperature interior. Moreover, in the cooling slowdown step S2, cooling efficiency (mist density) is regulated by the controller 41 so that the outer surface of the treatment object M does not reach the transformation point Ms by the cooling.

The cooling slowdown step S2 is performed until the temperature of the interior of the treatment object M reaches the target temperature Ta. By this means, it is possible to reliably prevent the temperature of the whole of the treatment object M from becoming higher than the target temperature Ta. The temperature of the interior of the treatment object M in the present embodiment is measured by using and cross-referencing the measurement result of the temperature sensor 80 provided on the outer surface of the treatment object M and the table data stored in the memory of the controller 41.

As shown in FIG. 5B, the treatment object M that has passed through this cooling slowdown step S2 has the moderated temperature distribution at the interior and exterior thereof compared to FIG. 5A.

Next, in the heat treatment method of the present embodiment, the treatment object M is held for a prescribed period of time after stoppage of the supply of mist-like cooling liquid (second step S3).

In the second step S3, enlargement of the temperature difference between the interior and exterior of the treatment object M is suppressed during the mist cooling stoppage period, the temperature difference is moderated by heat conduction between the interior and exterior of the treatment object M, and thereby the temperature of the treatment object M is rendered approximately uniform. The mist cooling stoppage period of the second step S3 is continued until the temperature difference between the interior and exterior of the treatment object M is within a prescribed threshold value (e.g., 10° C.). In the present embodiment, the mist cooling stoppage period of the second step S3 is terminated when the temperature difference between the interior and exterior of the treatment object M falls within the prescribed threshold value while the internal and external temperatures of the treatment object M are being monitored. It is also acceptable to adopt a technique wherein the time until the temperature difference between the interior and exterior of the treatment object M falls within the prescribed threshold value is projected from the thermal conductivity and the temperature difference between the interior and exterior of the treatment object M, and the mist cooling stoppage period of the second step S3 is terminated when that time has elapsed.

As shown in FIG. 5C, with respect to the treatment object M that has passed through this second step S3, the internal and external temperatures are rendered uniform so as to become the target temperature Ta.

Finally, in the heat treatment method of the present embodiment, the treatment object M is cooled to a temperature lower than or equal to the transformation point Ms (third step S4).

In the third step S4, the treatment object M in a state where the temperature difference between the interior and exterior has been moderated by passing through the first step S1, the cooling slowdown step S2, and the second step S3 is cooled lower than or equal to the transformation point Ms, whereby the internal and external structures of the treatment object M are transformed into a martensitic structure at the approximately same time. If the target temperature Ta is set to a temperature that is higher than the transformation point Ms by more than 10° C., it is possible to minimally suppress the temperature difference between the interior and exterior of the treatment object M generated by the cooling of the third step S4, and achieve enhancement of quality.

In the cooling of the third step S4, the supply of mist-like cooling liquid may be restarted. Of course, in the case where it is unnecessary to rapidly cool the treatment object M, cooling of the treatment object M may be conducted, for example, by supplying cooling gas to the interior of the cooling chamber 160 by the gas cooling device 20. That is, the treatment object M is directly cooled by the supply/injection of cooling gas from the discharge ports 24 in the gas cooling device 20.

As described above, in the present embodiment, a heat treatment method is conducted which includes a first step S1 in which a treatment object M retained at a quenching temperature is mist cooled by supplying mist-like cooling liquid to a target temperature Ta near to and higher than a transformation point Ms at which the structure of the treatment object M begins to be transformed into a martensitic structure, a second step S3 following the first step S1 in which the treatment object M is retained for a prescribed time in a state where supply of mist-like cooling liquid is stopped, and a third step S4 following the second step S3 in which the treatment object M is cooled to a temperature lower than or equal to the transformation point Ms. Consequently, even if a temperature difference between the interior and exterior of the treatment object arises in the first step S1, enlargement of the temperature difference between the interior and exterior of the treatment object M is suppressed by the mist cooling stoppage period in the second step S3, and the temperature difference is moderated by heat conduction between the interior and exterior of the treatment object M. Moreover, by cooling the treatment object M lower than or equal to the transformation point Ms in a state where the temperature difference between the interior and exterior of the treatment object M has been moderated, the internal and external structures of the treatment object M can be transformed into a martensitic structure at the approximately same time. Since an approximately simultaneous transformation of the internal and external structures of the treatment object M occurs, internal stress in the treatment object M does not arise. Accordingly, in the present embodiment, irregularity and deformation in the structure of the treatment object M can be suppressed.

Moreover, between the first step S1 and the second step S3 in the present embodiment, a cooling slowdown step S2 is conducted in which mist-like cooling liquid is supplied so that the treatment object M is mist cooled at a mist density that is smaller than the mist density of the first step S1. Consequently, it is possible to prevent the temperature of the whole of the treatment object M from becoming higher than the target temperature Ta due to heat conduction from the high-temperature interior, and reaching the transformation point Ps of another structure that is not desired. That is, by slowing the cooling of the treatment object M before the second step begins, cooling is conducted so that the temperature difference between the interior and exterior of the treatment object M is moderated, and the temperature rise of the whole of the treatment object M due to heat conduction from the high-temperature interior is canceled. By preventing the temperature of the whole of the treatment object M from becoming higher than the target temperature due to heat conduction between the interior and exterior of the treatment object M, irregularity and deformation in the structure of the treatment object M can be more reliably suppressed.

As the cooling liquid in the foregoing embodiment, for example, fluorine inert liquid may be used.

In the case where fluorine inert liquid is used, since the liquid does not erode the construction material of the treatment object M, adverse effects on the treatment object M can be prevented. Since the fluorine inert liquid is non-flammable, it is also possible to enhance safety. Since the boiling point of the fluorine inert liquid is higher than that of water, its cooling potential is also higher. In the case where fluorine inert liquid is used, problems such as oxidation and a vapor film which occur by using water can also be inhibited. The fluorine inert liquid has excellent heat transfer capability in terms of latent heat of vaporization, enabling efficient cooling of the treatment object M. Furthermore, since there is no need for cleaning the treatment object M even if the fluorine inert liquid adheres thereto, productivity can also be enhanced.

Experimental Example

Hereinafter, the effects of the present invention are made clearer with reference to the graphs shown in FIGS. 6-9.

Figure 6:
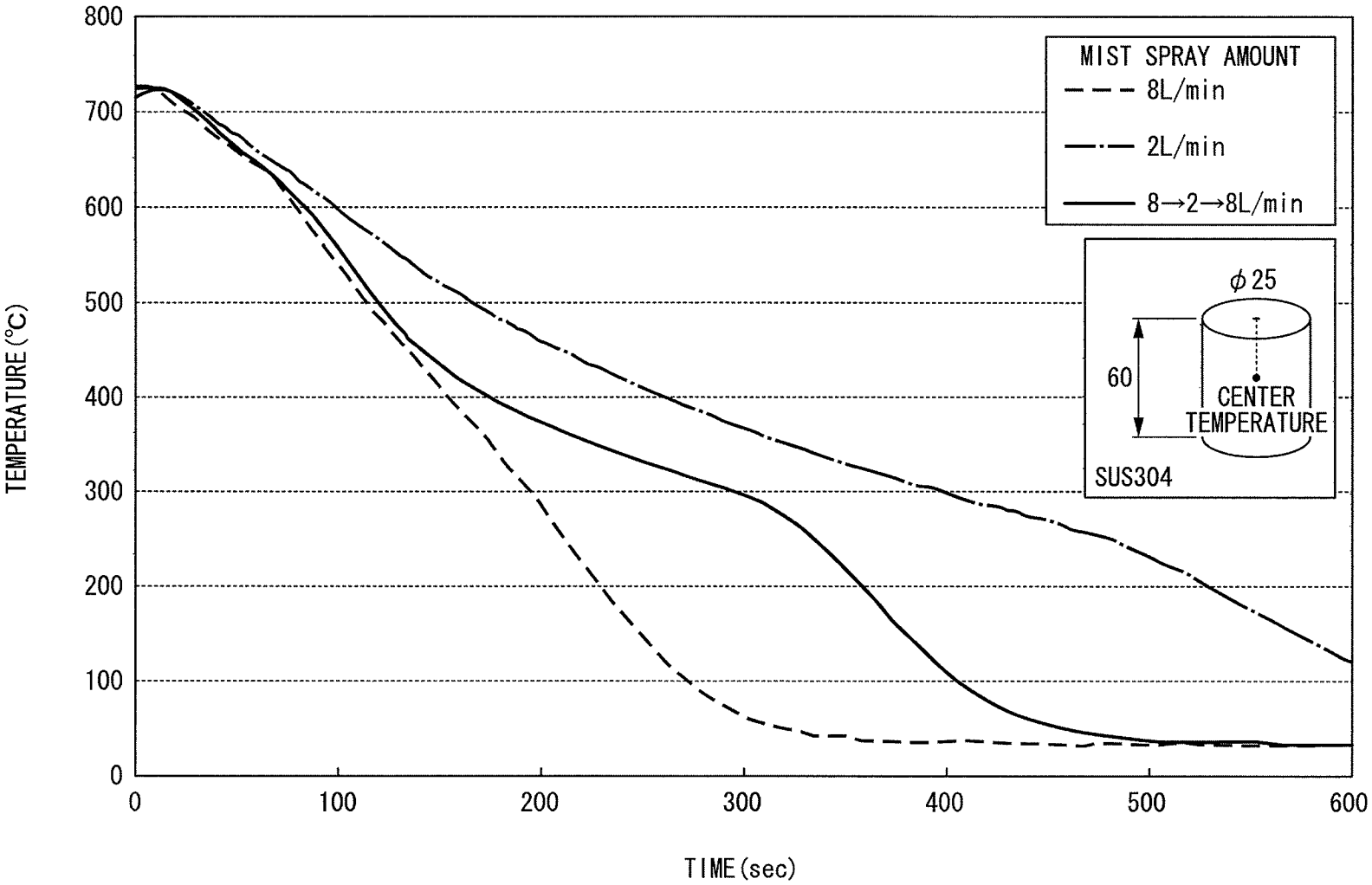
FIG. 6 is a graph showing results of a mist cooling experiment.

FIG. 6 is a graph which shows the results of an experiment concerning mist cooling. In the present experiment, it was investigated how the temperature of the central portion of a columnar treatment object composed of SUS304 (ϕ25 mm×60 mm) changes, when the mist spray amount (mist density) to the treatment object is varied.

FIG. 6 shows temperature changes of the treatment object at a furnace pressure of 50 kPa, using one nozzle, under the spray condition of the case where the mist spray amount is set at 8 L/min, the case where the mist spray amount is set at 2 L/min, or the case where the mist spray amount is varied in the manner of 8 L/min→2 L/min→8 L/min.

As shown in FIG. 6, the cooling speed of the treatment object can be optionally changed by varying the mist spray amount. Moreover, the cooling speed can be reduced by decreasing the mist spray amount in mid-course.

Figure 7:
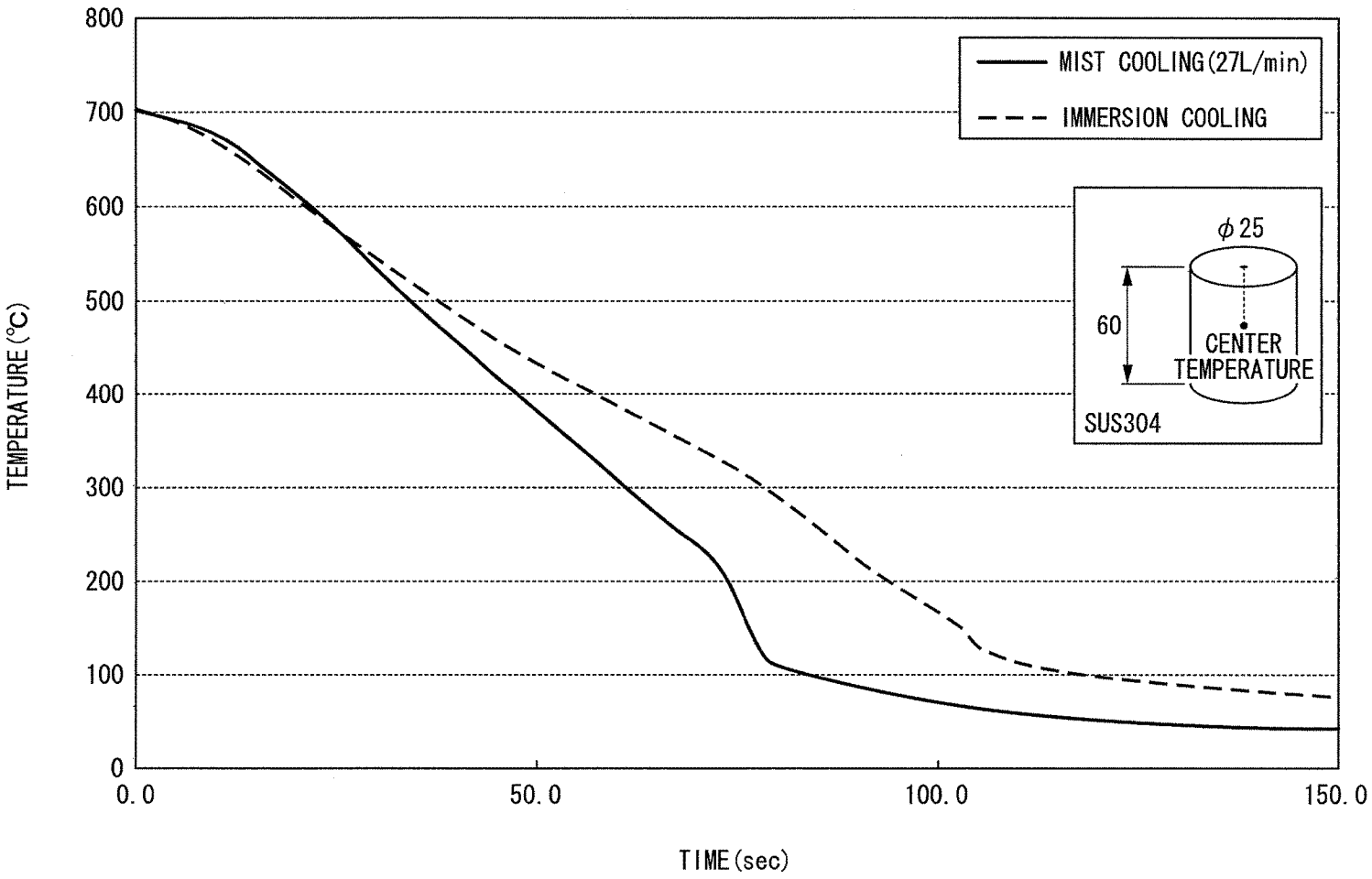
FIG. 7 is a graph showing results of a mist cooling experiment.

FIG. 7 is a graph which shows the results of an experiment concerning mist cooling. In the present experiment, it was investigated how the temperature of the central portion of a columnar treatment object composed of SUS304 (ϕ25 mm×60 mm) changes, when mist cooling or immersion cooling is conducted.

FIG. 7 shows temperature changes of the treatment object under the cooling condition of the case where mist cooling is conducted at a furnace pressure of 50 kPa, using three nozzles, with constant spraying in a total mist spray amount of 27 L/min (9 L/min from each nozzle), or the case where immersion cooling is conducted.

As shown in FIG. 7, it is clear that mist cooling can more quickly cool the treatment object than immersion cooling where the treatment object is cooled by soaking it in coolant, and that the cooling performance of mist cooling is high.

Figure 8:
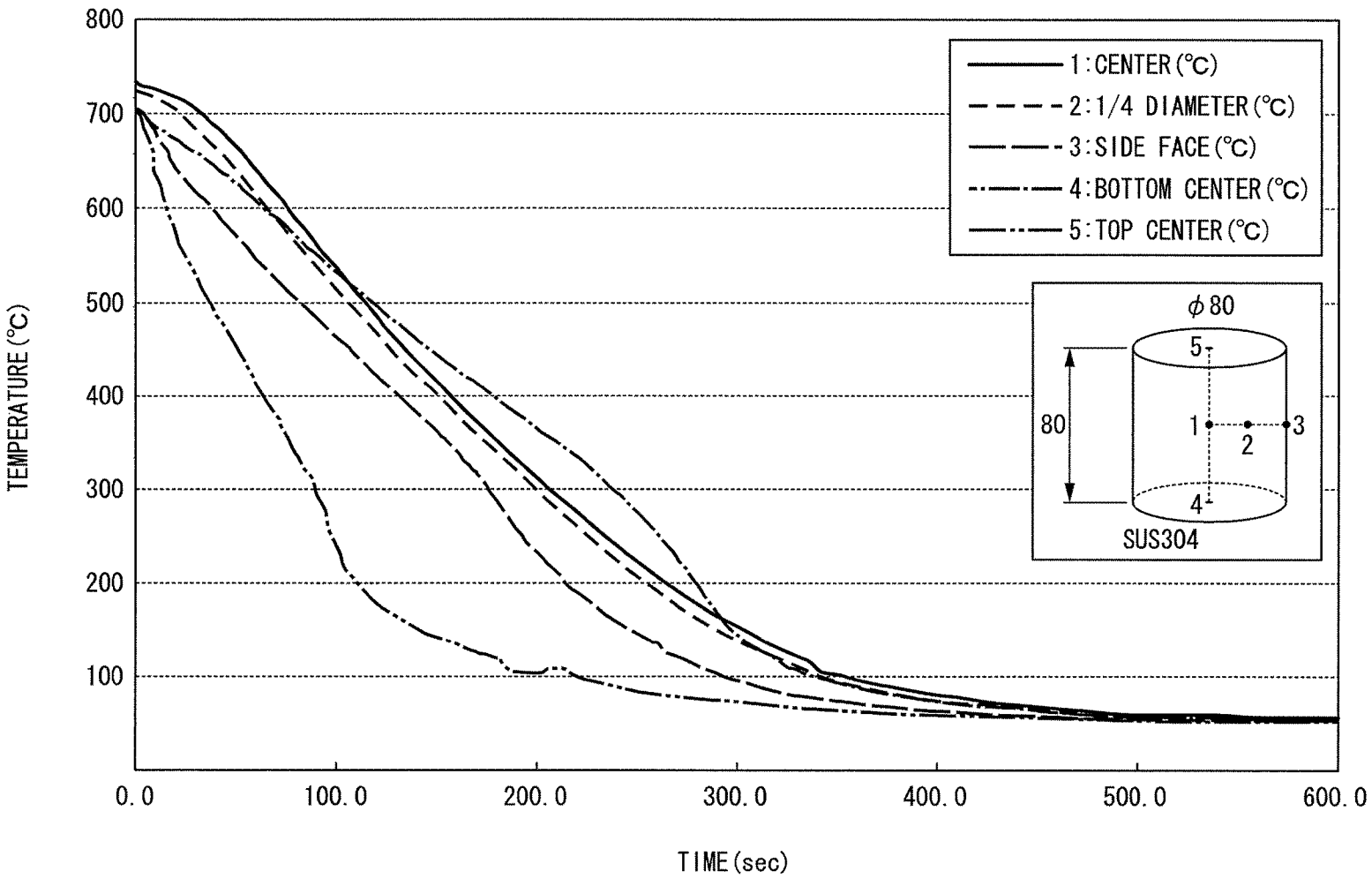
FIG. 8 is a graph showing results of a mist cooling experiment.

FIG. 8 is a graph which shows the results of an experiment concerning mist cooling. In the present experiment, an investigation was made of changes in the temperatures of the central portion, the portion inward in the radial direction from a side face by only ¼ of the diameter (¼ diameter), the side face, the central bottom portion, and the central top portion of a columnar treatment object composed of SUS 304 (ϕ80 mm×80 mm), in the case where the treatment object is mist cooled.

FIG. 8 shows the temperature changes of each portion of the treatment object in the case where a furnace pressure is 50 kPa, and constant spraying is conducted using three nozzles in a total mist spray amount of 27 L/min (9 L/min from each nozzle).

As shown in FIG. 8, it is clear that there is progression in the enlargement of the temperature difference between the interior and exterior of the treatment object when cooling is conducted by continuously spraying mist in a constant manner.

Figure 9:
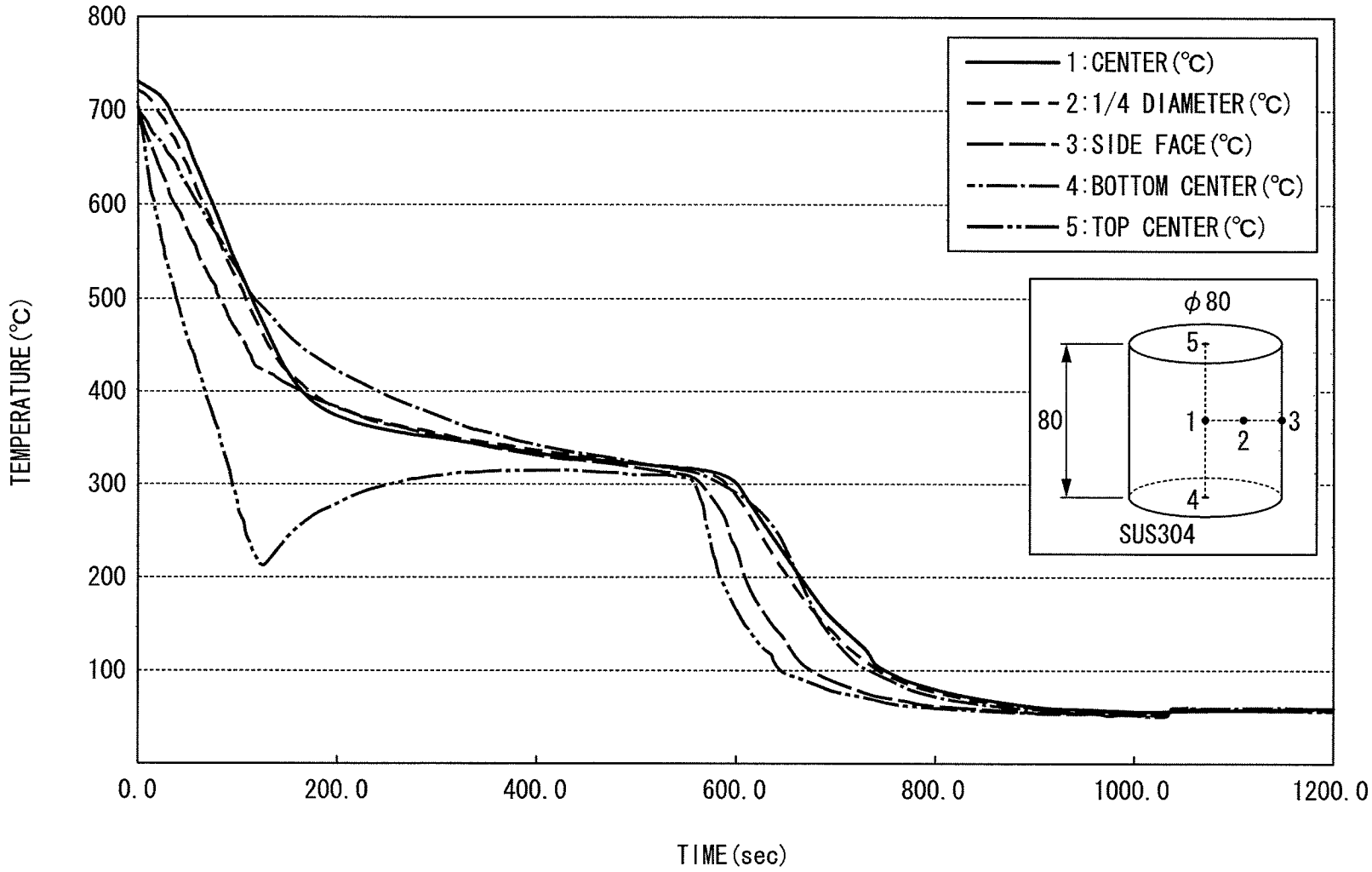
FIG. 9 is a graph showing results of a mist cooling experiment.

FIG. 9 is a graph which shows the results of an experiment concerning mist cooling. In the present experiment, an investigation was made of changes in the temperatures of the central portion, the ¼ diameter portion, the side face, the central bottom portion, and the central top portion of a columnar treatment object composed of SUS 304 (ϕ80 mm×80 mm), in the case where mist cooling of the treatment object is temporarily stopped in mid-course.

FIG. 9 shows the temperature changes of each portion of the treatment object in the case where a furnace pressure is 50 kPa, spraying is conducted using three nozzles in a total mist spray amount of 27 L/min (9 L/min from each nozzle), and the total mist spray amount is varied in the manner of 27 L/min→0 L/min→27 L/min.

As shown in FIG. 9, it is clear that the temperature difference between the interior and exterior of the treatment object is moderated by temporarily stopping spraying, and that cooling progresses.

While a preferred embodiment of the present invention has been described and illustrated above with reference to appended drawings, the present invention is not limited within the above embodiment. The various forms, combinations and the like of the components shown in the foregoing embodiment are exemplary, and may be modified based on design requirements and the like within a scope of the present invention.

For example, as a method for adjusting mist density, the aforementioned supply amount adjustment of the cooling liquid using the pump 38 and motor 39, supply pressure adjustment, supply time adjustment (frequency adjustment using a throttle valve or the like), or the like may be used.

In the foregoing embodiment, it is described that the temperature of the treatment object M is measured by the temperature sensor 80, and that the internal temperature of the treatment object M is measured based on the measured temperature, but it is also acceptable to separately provide a temperature sensor which measures the internal temperature of the treatment object M.

The supply of cooling liquid described in the foregoing embodiment is normally conducted under a vacuum, but it is also acceptable, for example, to add the aforementioned inert gas during mist cooling.

Normally, the boiling point increases when atmospheric pressure is high, and the boiling point decreases when atmospheric pressure is low. Consequently, by adjusting the additive amount of inert gas and thus raising atmospheric pressure, cooling capacity by the latent heat of vaporization of the cooling liquid can be enhanced. Conversely by lowering atmospheric pressure, the boiling point is decreased, the temperature difference between the boiling point and the supply liquid temperature is narrowed, and cooling speed (cooling capacity) can be suppressed.

In this manner, by adjusting the additive amount of inert gas, it becomes possible to control cooling properties with respect to the treatment object M, and to perform a more high-precision cooling.

In the foregoing embodiment, the configuration was adopted using the gas cooling device 20 together with the mist cooling device 30, but the present invention is not limited thereto, and it is also acceptable to only provide the mist cooling device 30.

In the foregoing embodiment, oil, salty liquid, fluorine inert liquid and the like were enumerated as cooling liquid, but in addition to these, it is also acceptable to use water when the influence of oxidation and a vapor film is slight. In the case where water is used as the mist-like cooling liquid, treatment is preferably conducted under conditions ranging from an adjusted atmospheric pressure of 48 kPa (abs) where the boiling point is 80° C. to an adjusted atmospheric pressure of 70 kPa (abs) where the boiling point is 90° C., for the same reasons as when the aforementioned fluorine inert liquid is used.

In the case where water is used as the cooling liquid, with either the liquid phase or the gaseous phase, discharge can be safely conducted without the need for troublesome after-treatment, which is favorable in terms of cost pertaining to aftertreatment and protection of the global environment.

In the foregoing embodiment, it was described that stoppage of the supply of mist-like cooling liquid is retained for a prescribed time in the second step S3, but it is also possible to suppress enlargement of the temperature difference between the interior and exterior of the treatment object M, and to moderate the temperature difference by heat conduction between the interior and exterior of the treatment object M even when the treatment object M after the first step S1 is mist cooled for a prescribed time at a mist density that is less than the mist density of the first step S1 without stopping the supply of mist-like cooling liquid.

INDUSTRIAL APPLICABILITY

According to the present invention, it is possible to provide a heat treatment method capable of suppressing irregularity and deformation in the structure of a treatment object.

DESCRIPTION OF REFERENCE SIGNS

20: gas cooling device
30: mist cooling device
32: supply pipe
34: nozzle
41: controller
80: temperature sensor
100: vacuum heat treatment furnace (heat treatment device)
160: cooling chamber
CU: cooling unit
M: treatment object
S1: first step
S2: cooling slowdown step
S3: second step
S4: third step

The invention claimed is:

1. A heat treatment method, comprising:

a first step of mist cooling a treatment object retained at a prescribed temperature by supplying coolant in mist form capable of cooling the treatment object by latent heat of vaporization of the coolant from nozzles, to a target temperature near to and higher than a first transformation point at which a structure of the treatment object begins to be transformed into a prescribed first structure;

a second step, following the first step, of retaining the treatment object for a prescribed time in a state where supply of the coolant in mist form is stopped; and a third step, following the second step, of cooling the treatment object from a temperature higher than the first transformation point to a temperature lower than or equal to the first transformation point; and a cooling slowdown step between the first step and the second step, of supplying coolant in mist form capable of cooling the treatment object by latent heat of vaporization of the coolant from the nozzles so that the treatment object is mist cooled at a mist density that is less than a mist density of the first step, wherein the temperature of the treatment object at the time the third step is started is higher than the first transformation point, the target temperature is set between the first transformation point and a second transformation point with a temperature higher than the first transformation point at which the structure of the treatment object is transformed into a second structure other than the first structure, and in the second step and the cooling slowdown step, temperatures of an outer surface and of an interior of the treatment object are maintained to be higher than the first transformation point and to be lower than the second transformation point.

2. The heat treatment method according to claim 1, further comprising a step of measuring a temperature of an outer surface of the treatment object;

wherein transition occurs from the first step to the cooling slowdown step when a measured temperature of the outer surface reaches the target temperature.

3. The heat treatment method according to claim 1, further comprising a step of measuring a temperature of the interior of the treatment object, wherein transition occurs from the cooling slowdown step to the second step when a measured temperature of the interior reaches the target temperature.

4. The heat treatment method according to claim 3, wherein a temperature of the interior of the treatment object is measured based on a temperature of an outer surface of the treatment object.

5. A heat treatment method, comprising:

a first step of mist cooling a treatment object retained at a prescribed temperature by supplying coolant in mist form capable of cooling the treatment object by latent heat of vaporization of the coolant from nozzles, to a target temperature near to and higher than a first transformation point at which a structure of the treatment object begins to be transformed into a prescribed first structure;

a second step, following the first step, of supplying coolant in mist form capable of cooling the treatment object by latent heat of vaporization of the coolant from the nozzles so that the treatment object is mist cooled for a prescribed time at a mist density that is less than a mist density of the first step; and a third step, following the second step, of cooling the treatment object from a temperature higher than the first transformation point to a temperature lower than or equal to the first transformation point, wherein the temperature of the treatment object at the time the third step is started is higher than the first transformation point, the target temperature is set between the first transformation point and a second transformation point with a temperature higher than the first transformation point at which the structure of the treatment object is transformed into a second structure other than the first structure, and in the second step, temperatures of an outer surface and of an interior of the treatment object are maintained to be higher than the first transformation point and to be lower than the second transformation point.

6. The heat treatment method according to claim 1, wherein the first transformation point is a martensite transformation point, and the second transformation point is a pearlite transformation point.

7. The heat treatment method according to claim 1, wherein the second step is completed when a temperature difference between interior and exterior of the treatment object is within a prescribed threshold value, and thereafter, the third step is started.

8. The heat treatment method according to claim 1, wherein in the third step, the treatment object is cooled to a temperature lower than or equal to the first transformation point by supplying coolant in mist form or by supplying cooling gas.

9. The heat treatment method according to claim 7, wherein in the third step, the treatment object is cooled to a temperature lower than or equal to the first transformation point by supplying coolant in mist form or by supplying cooling gas.

10. The heat treatment method according to claim 5, wherein the second step is completed when a temperature difference between interior and exterior of the treatment object is within a prescribed threshold value, and thereafter, the third step is started.

11. The heat treatment method according to claim 5, wherein in the third step, the treatment object is cooled to a temperature lower than or equal to the first transformation point by supplying coolant in mist form or by supplying cooling gas.

12. The heat treatment method according to claim 10, wherein in the third step, the treatment object is cooled to a temperature lower than or equal to the first transformation point by supplying coolant in mist form or by supplying cooling gas.

13. The heat treatment method according to claim 1, wherein in the cooling slowdown step, the mist density of the coolant discharged from the nozzles is adjusted by adjusting the supply amount of the coolant, the supply pressure of the coolant, or the supply time of the coolant.

14. The heat treatment method according to claim 5, wherein in the second step, the mist density of the coolant discharged from the nozzles is adjusted by adjusting the supply amount of the coolant, the supply pressure of the coolant, or the supply time of the coolant.

* * * * *